US006309327B1

(12) United States Patent
Hallberg

(10) Patent No.: US 6,309,327 B1
(45) Date of Patent: Oct. 30, 2001

(54) REACTION AND TECHNIQUE DEVELOPMENT SLED

(75) Inventor: Edwin A. Hallberg, Midland, MI (US)

(73) Assignee: Rogers Athletic Company, Clare, MI (US)

( * ) Notice: Subject to any disclaimer, the term of this patent is extended or adjusted under 35 U.S.C. 154(b) by 0 days.

(21) Appl. No.: 09/395,337

(22) Filed: Sep. 13, 1999

(51) Int. Cl.[7] ..... A63B 67/00
(52) U.S. Cl. ..... 482/83; 482/87; 482/90
(58) Field of Search ..... 473/441, 422, 473/438, 442–445; 482/87, 83, 90; 434/251

(56) References Cited

U.S. PATENT DOCUMENTS

| | | |
|---|---|---|
| 2,521,649 | 9/1950 | Paupa . |
| 3,649,016 | 3/1972 | Kelley, Jr. . |
| 3,684,283 | 8/1972 | Forrest . |
| 3,827,690 | 8/1974 | Rogers . |
| 3,897,060 | 7/1975 | Jennings . |
| 4,447,056 | 5/1984 | Dalton . |
| 4,477,076 | 10/1984 | Monaco . |
| 5,013,039 | 5/1991 | Cole . |
| 5,385,523 | 1/1995 | Forrest . |
| 5,462,272 | 10/1995 | Staten . |
| 5,743,821 | 4/1998 | Wirachowski . |

*Primary Examiner*—Jerome W. Donnelly
(74) *Attorney, Agent, or Firm*—David M. Thimmig; Mayer, Brown & Platt

(57) ABSTRACT

An athletic training device having at least a base, a pad assembly and biasing members is adapted to permit primary rotation and translation, as well as secondary rotation of the pad assembly. Primary movement may be triggered by an operator to assist in developing faster player reaction times, while the secondary movement is permitted to assist players in developing techniques involved in engaging an opposing player.

18 Claims, 7 Drawing Sheets

FIG. 1
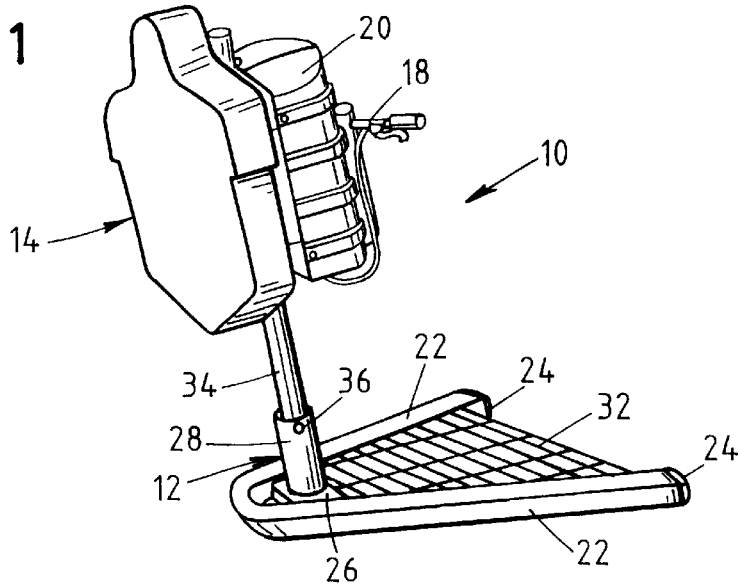
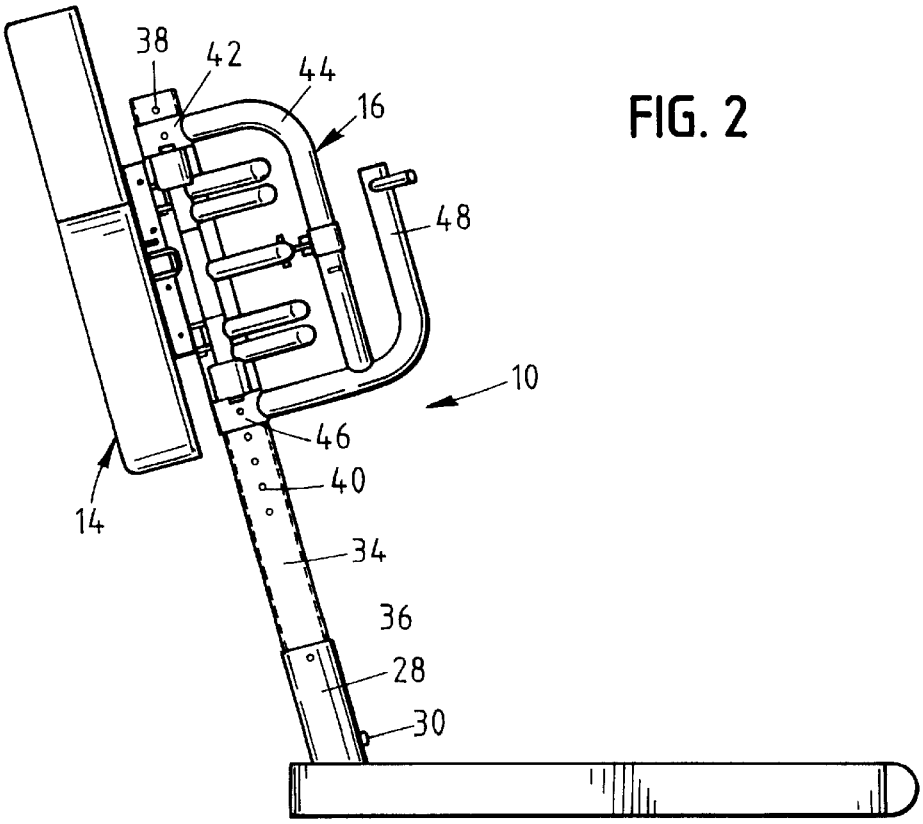
FIG. 2

REACTION AND TECHNIQUE DEVELOPMENT SLED

BACKGROUND OF THE INVENTION

1. Field of the Invention

The present invention generally relates to athletic training devices, and more particularly to a football practice sled for training players to react to an opposing player's movement and to improve the technique involved in engaging an opposing player. The practice sled of the present invention includes a new pad assembly suspension system and control system that permit primary rotations and translation, as well as secondary rotations of a pad assembly.

2. Discussion of the Prior Art

Football blocking or tackling sleds and hand held pads are well known. Such devices are frequently used in football player practice sessions to assist in developing techniques for successfully encountering opposing players. Some practice devices use resilient structural assemblies connected to pads to permit the assembly to absorb some of the energy of the player impact, so as not to cause injury to the player. Such devices do not simulate movement of the opposing player prior to contact and do not train a player to fight through the rotational resistance of the opposing player.

Also common in the art are practice devices that incorporate a sled to permit one or more players to engage the sled and move it under force. These devices may be teamed with the resilient structures to permit a player to simulate driving an opposing player rearward after initial contact, but are not typically designed to simulate the initial movement or rotational resistance of an opposing player.

Still other prior practice devices have employed means for coaches to interject movement of a device to assist in eliciting an initial reaction from a defensive lineman, such as through movement of a football or a pad. Such devices, while employing means that assist in training a player's reaction, typically are cumbersome to operate and do not provide realistic movement and resistance of the opposing player prior to or after contact by the practicing player.

In light of the shortcomings of prior art football practice devices, it is desirable to have a football practice training device with a new and improved pad suspension system for assisting in development of player reaction to an opposing player's movement and player technique for engaging an opposing player. Accordingly, it is advantageous to provide a practice sled which can be operated by a coach or instructor to simulate movement of an opposing player. It also is advantageous that the device have simple controls and be able to be reset by engagement of the player during the practice drill. It is desirable that the practice device have more than one directional movement available to more realistically resemble, move, and react like an opposing player. It is further advantageous to provide a practice sled that will assist in teaching a player to rotate and drive through the resistance of an opposing player. It is still further advantageous to have a practice device that permits defensive training whereby a player is trained to react to an offensive player's movement, and fight through a block to escape the offensive player and finish the play. It is further desirable to have a device that may be used to train offensive linemen in hand placement and jamming on-rushing defenders. The present invention overcomes the disadvantages of the prior art, while providing the above mentioned desirable features of a football practice reaction and technique development sled.

SUMMARY OF THE INVENTION

The purpose and advantages of the invention will be set forth in and apparent from the description and drawings that follow, as well as will be learned by practice of the invention disclosed and claimed herein.

The present invention is generally embodied in an improved athletic training device which can be used for a variety of football practice drills. The athletic training device comprises a base, a pad assembly suspension system connected to the base and having at least one primary biasing member, a pad assembly connected to the pad assembly suspension system, a control system connected to the pad assembly suspension system, and at least one secondary biasing member connected to the pad assembly suspension system. The control system and pad assembly suspension system are adapted to selectively advance at least a portion of the pad assembly when the control system is triggered by an operator.

In a further aspect of the invention, the control system, pad assembly and pad assembly suspension system are adapted to selectively advance the entire pad assembly.

In another aspect of the invention, the athletic training device is a football practice sled that comprises a base, a pad assembly suspension system connected to the base, a pad assembly connected to the pad assembly suspension system, and a control system connected to the pad assembly suspension system. The pad assembly suspension system is adapted to permit primary and secondary rotation of the pad assembly and the control system may be activated to select at least an initial primary rotation of the pad assembly.

In another aspect of the invention, the pad assembly has a reset position and contact by a player may counteract the initial primary rotation to return the pad assembly to the reset position. Further, contact by a player may impart secondary rotation of the pad assembly after the pad assembly has been returned to the reset position.

In still a further aspect of the invention, a football practice sled comprises a base having ground engaging runners and an upwardly extending collar, an axle connected to the collar, a pad assembly connected to axle, and the pad assembly has at least one primary biasing member adapted to impart movement of the pad assembly relative to the base.

In yet a further aspect of the invention, the sled further comprises at least one latch connected to the pad assembly to restrain movement of the pad assembly by a compressed primary biasing member when the sled is in a reset position. The sled may further comprise at least one secondary biasing member adapted to resist a force applied to the pad assembly. The sled may further have a reset position in which the at least one secondary biasing member is substantially not compressed.

It is to be understood that both the foregoing general description and the following detailed description are exemplary and provided for purposes of explanation only, and are not restrictive of the invention, as claimed. Further features and objects of the present invention will become more fully apparent in the following description of the preferred embodiment of this invention and from the appended claims.

BRIEF DESCRIPTION OF THE DRAWINGS

In describing the preferred embodiment, reference is made to the accompanying drawings wherein like parts have like reference numerals, and wherein:

FIG. 1 is a perspective view of the preferred embodiment of a practice sled of the present invention with a protective backing installed.

FIG. 2 is a side view of the sled of FIG. 1 without a protective backing, or biasing and control mechanisms, illustrating some of the structural members.

Figure 3:
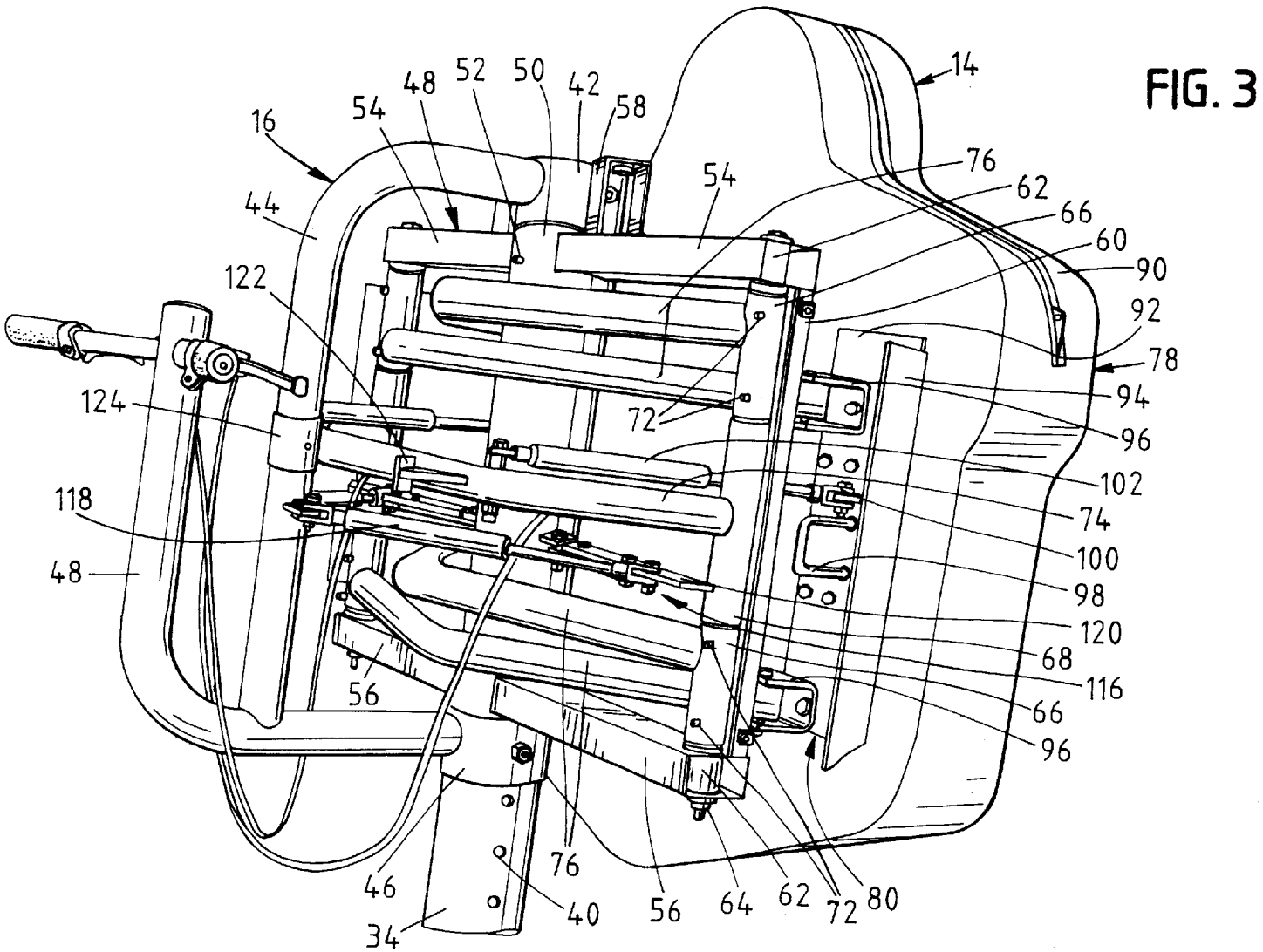
FIG. 3 is a rear perspective view of the upper portion of the sled of FIG. 1 without a protective backing, illustrating the pad in the right side advanced position.

It should be understood that the drawings are not to scale and that certain aspects are illustrated in phantom views. While considerable mechanical details of a reaction and technique development sled, including details of fastening means and other plan and section views of the preferred embodiment depicting the invention have been omitted, such detail is not per se part of the present invention and is considered well within the comprehension of those skilled in the art in light of the present disclosure. It should also be understood that the present invention is not limited to the preferred embodiment illustrated.

DETAILED DESCRIPTION OF THE PREFERRED EMBODIMENT

Referring generally to FIGS. 1–11, it will be appreciated that the present invention generally may be embodied in numerous configurations of a practice sled.

Referring now to FIGS. 1 and 2, a preferred embodiment of the present invention is shown in a practice sled 10. The sled 10 includes a base 12, a pad assembly 14, a pad assembly suspension system 16, a control assembly 18, a protective backing 20, and ground-engaging runners 22. Many of the rigid components of the preferred embodiment of sled 10 shown in FIG. 1 are made from conventional steel products, such as circular or square tubing, or flat sheet or bar stock. These components and are joined by conventional methods, such as by welding or with common fasteners. However, it will be appreciated that suitable alternative materials and methods of joining components may be employed, in keeping with the invention.

Runners 22 may be formed from a single structural element as shown, or may be formed as separate elements. In either event, the runners 22 may be formed of suitable material, such as the steel box tube shown. The runners 22 also may include rear caps 24, or upwardly turned rear ends, or other structures or shapes to facilitate rearward sliding on top of the ground surface. Extending between the runners 22 is a gusset 26 of tubular construction, with an upstanding base collar 28 passing through its upper wall. The base collar 28 is fixed in a position extending upward and forward from the gusset 26 and includes a set screw 30. Also extending between the runners is grating 32. Other suitable platform materials and structures could be employed to hold the operator/instructor. The components of the base 12 are of durable construction, such as steel, and are rigidly fixed together, such as by welding. The backing 20 may be constructed of durable material in any suitable manner, such as molded, textured black ABS plastic.

Sled 10 of the preferred embodiment also includes major axle 34, which fits into sleeve 28 and is fixed in place by a fastener, such as a nut and bolt assembly 36. Major axle 34 may be further held in position, so as to prevent vibration and rattling, by set screw 30. The pad assembly suspension system 16 is mounted on major axle 34. Major axle 34 has a series of upper and lower through holes 38 and 40, respectively. The suspension system 16 has an upper major collar 42 connected to downward extending rear member 44, and a lower major collar 46 connected to upward extending control member 48. Upper and lower major collars 42 and 46 are held a fixed distance apart by connection of rear member 44 and control member 48, such as by welding. The suspension system 16 is height adjustable by aligning the appropriate through holes 38 and 40 with through holes in respective upper and lower major collars 42 and 46, and installing suitable fasteners, such as nut and bolt assemblies.

Figure 4:
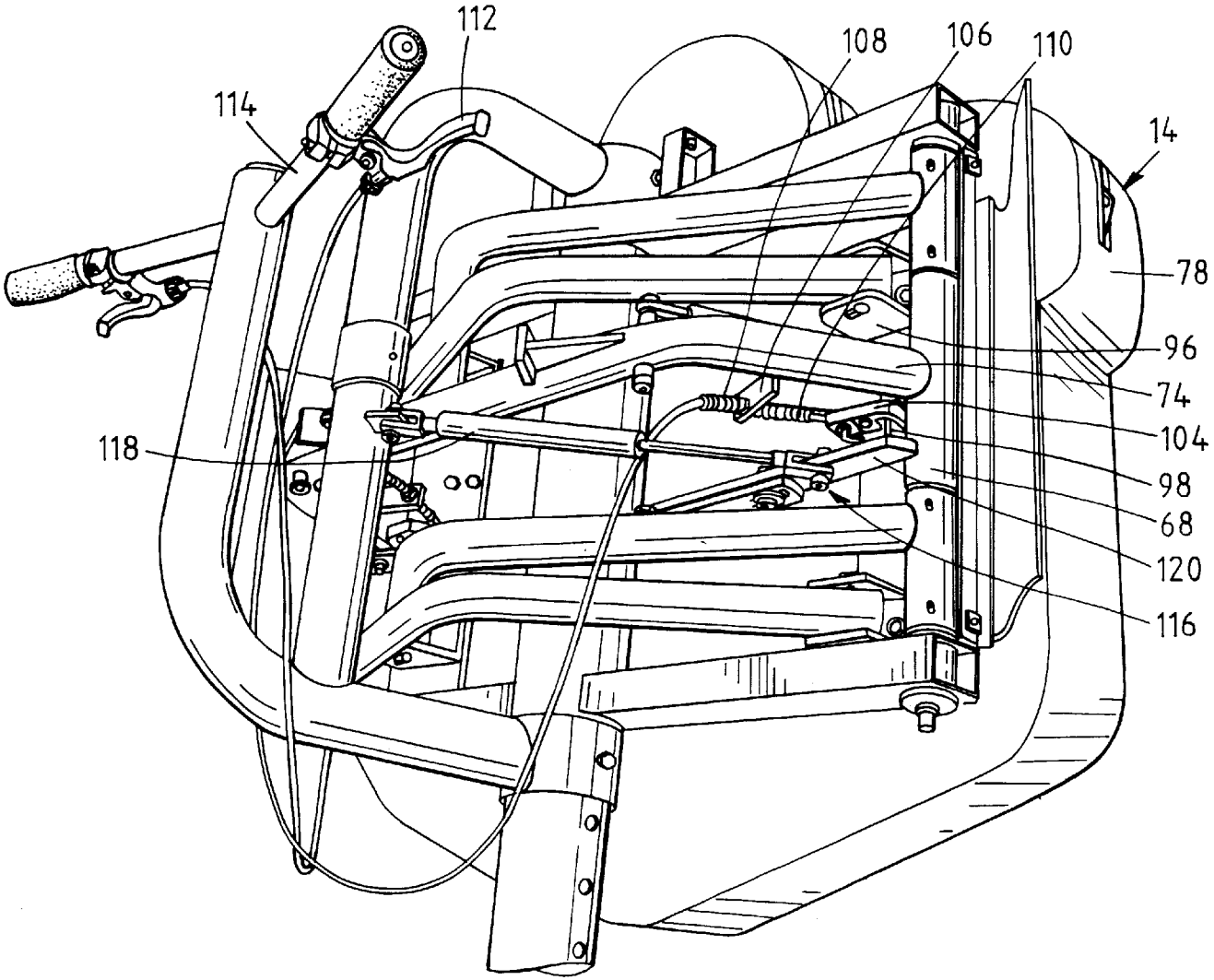
FIG. 4 is a rear perspective view of the sled of FIG. 1 without a protective backing, illustrating the pad in the ready position.

Referring now to FIGS. 3 and 4, pad assembly suspension system 16 includes frame 48 mounted between collars 42 and 46. Frame 48 has a sleeve 50, with grease fittings 52, for rotational mounting relative to major axle 34. Frame 48 also includes upper horizontal members 54 and lower horizontal members 56 fixed at their inner ends to the respective left and right sides of sleeve 50, such as by welding. Alternatively, frame 48 could be constructed to permit pivotal connection and could have unitary upper and lower horizontal members, or other suitable structure.

Fixed atop the upper horizontal members 54 of the preferred embodiment are mounting brackets 58. Mounting brackets 58 are provided for attachment of the top of protective backing 20 to the suspension system 16, by conventional fasteners such as bolt into fixed nut. Similar fastening positions are provided along side brackets 60 for the sides of protective backing 20. Each side bracket 60 is fixed, such as by welding, at the end of the respective upper and lower horizontal members 54 and 56. The side brackets 60 may be made of flat bar stock, and may serve to help fixture or hold components in place during welding operations.

Fixed near the outer end of each respective upper and lower horizontal member 54 and 56 is a bushing 62 with a grease fitting. A minor axle 64 is mounted for rotation within each respective pair of upper and lower bushings 62. Mounted on minor axle 64 between the upper and lower bushings 62 on each side of suspension system 16 are a pair of collars 66 and a sleeve 68. Sleeve 68 is permitted to rotate about minor axle 64. The collars 66 are held in fixed position relative to minor axle 64 by set screws 72, which also serve to hold minor axle 64 in its vertical position for rotation within upper and lower bushings 62.

The left and right sleeves 68 are connected to the respective left and right ends of common link 74, such as by welding. Each of the collars 66 on the right and left sides of pad assembly suspension system 16 has a first end of a bent link 76 fixed thereto, such as by welding. A portion of each link 76 passes between the rear member 44 and sleeve 50 on major axle 26. The links 76 are staggered in height so as not to interfere with each other. The second end of each bent link 76 is connected to the pad assembly 14 as discussed below.

Figure 5:
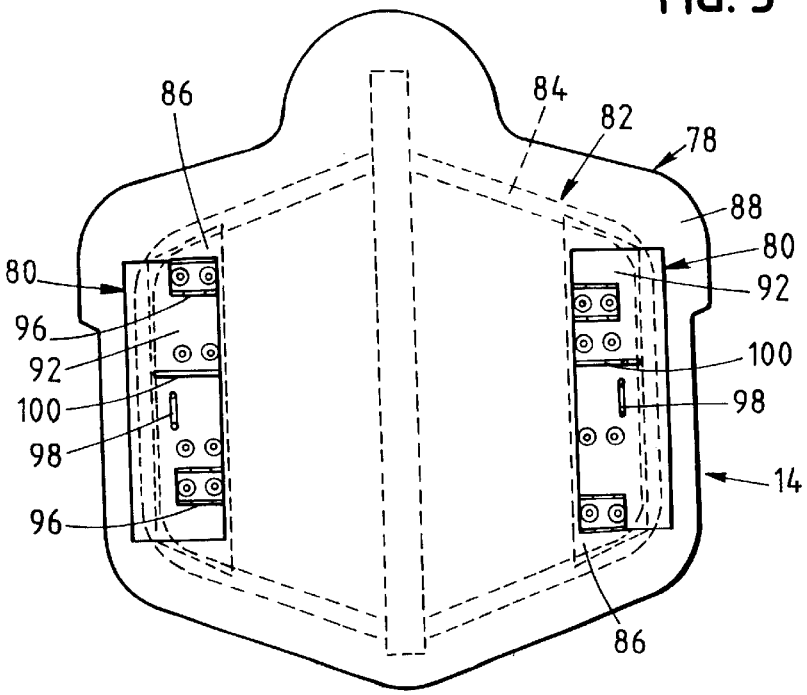
FIG. 5 is rear view of the pad assembly of the sled of FIG. 1 and its mounting structure.

As best seen in FIG. 5, the pad assembly 14 includes a pad 78 and locking assemblies 80 attached to the rear of pad 78. Pad 78 has an inner pad frame 82 having a skeleton 84, such as of steel tubing, with fastening plates 86 attached thereto, such as by welding. The fastening plates 86 have a series of fixed fastener components, such as the nuts of nut and bolt assemblies. The inner pad frame 82 is encased in a resilient material 88 made of suitable foam, such as low density urethane. As seen in FIG. 3, for increased durability, the pad 78 further includes a zippered vinyl cover 90 of conventional construction.

Each locking assembly 80 includes a base plate 92 with holes therethrough in a like pattern for alignment with the series of fixed fastener components of a respective fastening plate 86. Locking assemblies 80 are mounted to the rear of pad 78 by attachment of base plates 92 to fastening plates 86 via conventional fasteners. A pliable close-out panel 94, such as of sheet polyethylene construction, is attached between each locking assembly 80 and pad 78 to shield users of the sled 10 from inadvertently putting bodily parts in harms way between the rear of the pad 78 and the protective backing 20 shown in FIG. 1. The panel 94 can be configured to slide between the sleeve and collar arrangement on minor axle 64 and the side brackets 60.

Returning to FIGS. 3 and 5, attached to the base plate 92 of each locking assembly are upper and lower mounting brackets 96, a U-shaped lock bar 98 and a flange 100. In the preferred embodiment, each bracket 96 is of clevis form and has a slot in its upper and lower rearward extending legs. Each bracket 96 receives a respective second end of a link 76 between the upper and lower legs of the bracket 96 and is locked to the end of the link 76 by a roll pin or other suitable fastener passing through the link 76 and being free to translate or rotate within the slots (as best seen in reference to the right, upper bracket 94 in FIG. 4). The U-shaped lock bar 98 and flange 100 each extend rearward from the face of the base plate 92 and are fixed thereto, such as by welding.

Pad assembly suspension system 16 further includes a pair of primary biasing members 102. Although the biasing members 102 of the preferred embodiment are of the commonly available gas spring type, such as manufactured by Suspa, Incorporated, they may be of alternative configuration, such as coil springs. Each primary biasing member 102 is connected to the common link 74 at a first end, and connected to a flange 100 on a locking assembly 80 at a second end.

Figure 6:
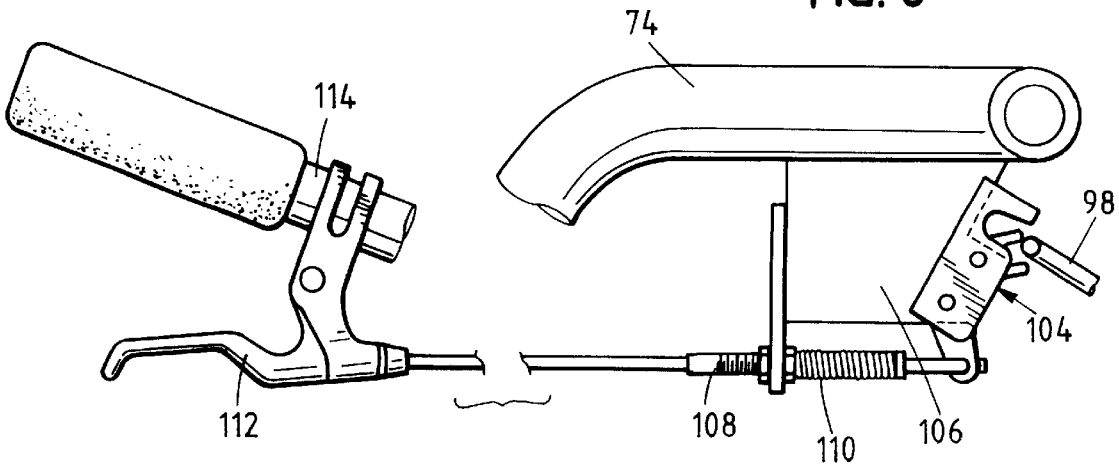
FIG. 6 is a top view of one of the latch and control assemblies used in the sled of FIG. 1.

As best seen in FIGS. 4 and 6, a latch 104 is attached to a mounting bracket 106 proximate each end of common link 74. The latch 104 is generally similar to the structure of latches used with vehicle deck lids, but could be of suitable alternative construction. Each latch 104 is connected to control assembly 14 via a first end of a conventional cable assembly 108. Each cable assembly 108 has a second end which is connected to a control lever 112, such as commonly used with bicycles and the like. The control levers 112 are connected to handle bars 114 of control assembly 14. Each cable assembly 108 is biased, such as by a spring 1 10, so that the latch 104 engages the U-shaped lock bar 98 on locking assembly 80 to hold the respective primary biasing member 102 in a compressed position.

Figure 7:
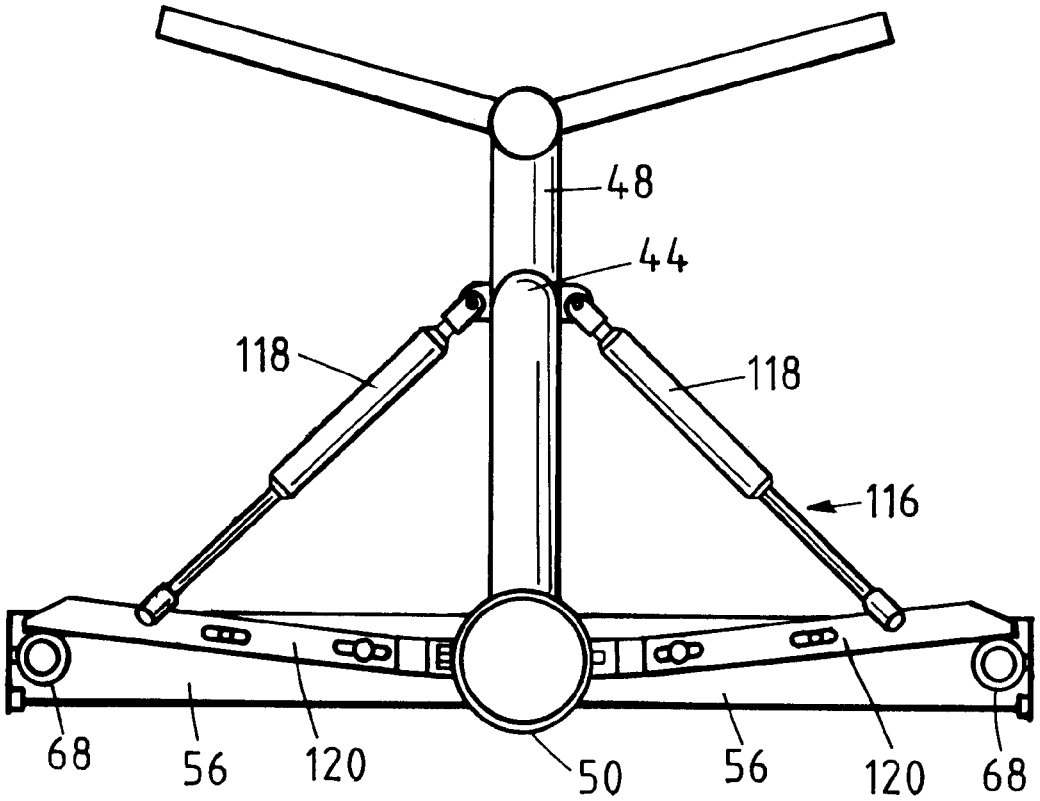
FIG. 7 is a top view of the centering assembly used in the sled of FIG. 1.

Best illustrated in FIGS. 3, 4 and 7 is a secondary rotation and centering assembly 116 which connects rear member 44 to major sleeve 50 via secondary biasing members 118 and bar assemblies 120 to control the rotation of pad assembly suspension system 16. Although gas springs are shown for secondary biasing members 118, alternative biasing elements may be employed. In contrast to the primary biasing members 102 which should be installed so as to be in a compressed position when the pad 78 is facing directly forward, the secondary biasing members 118 are preferably installed near the end of their full travel, to minimize damage to the biasing members relating to over-travel.

Each secondary biasing member 1 18 is connected at a first end to a tab on rear member 44. The second end of each biasing member 118 is connected to a bar assembly 120. Each bar assembly 120 is connected to a tab on sleeve 50 and includes bars which can be joined together by conventional fasteners and adjusted in length via slot arrangements. With a biasing member 118 essentially at its full travel, the centering bar assembly 120 may be adjusted in length to affect the angle of the centering bar assembly 118 relative to the pad assembly suspension system 16. For instance, if a bar assembly 120 is shortened, the outer end of the bar assembly 120 will move forward toward sleeve 68, whereas if it is lengthened, the outer end of bar assembly 120 will move rearward. When in proper adjustment, the bar assemblies 120 should be adjusted in length to pivot about the connection to the tab on major sleeve 50 until their outer ends are adjacent to or contact respective sleeves 68 on minor axles 64.

To limit the maximum secondary rotational travel of the pad assembly suspension system 16, stops 122 are connected to common link 74. Each stop 122 is positioned to contact rear member 44 prior to over extending its associated secondary biasing member 118. To prevent damage to rear member 44 due to repeated contact by stops 122, a collar 124 is crimped or otherwise fastened into place on rear member 44 to strengthen rear member 44 where it is contacted by stops 122.

Figure 8:
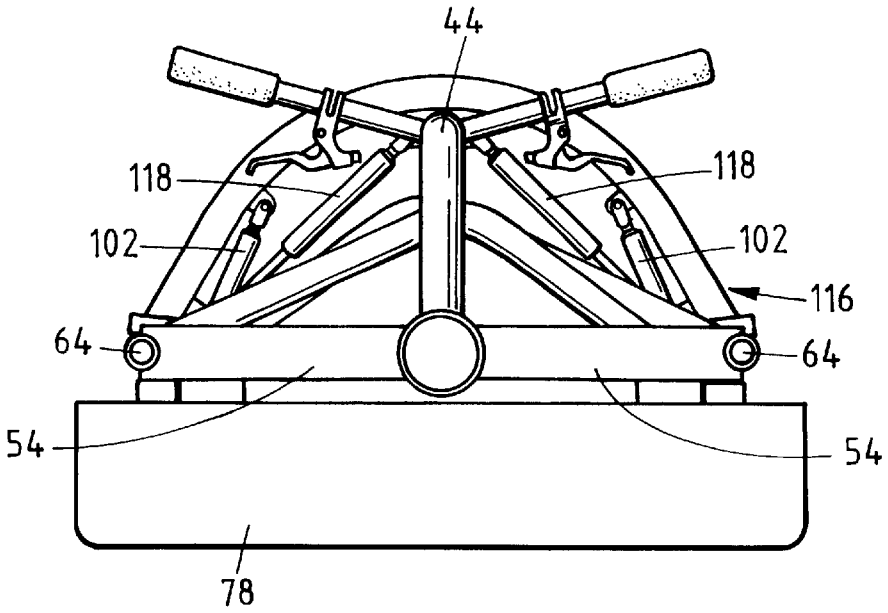
FIG. 8 is a top view of the upper portion of an embodiment of a practice sled of the present invention without the protective backing or control assemblies, illustrating the pad in the ready position.
Figure 9:
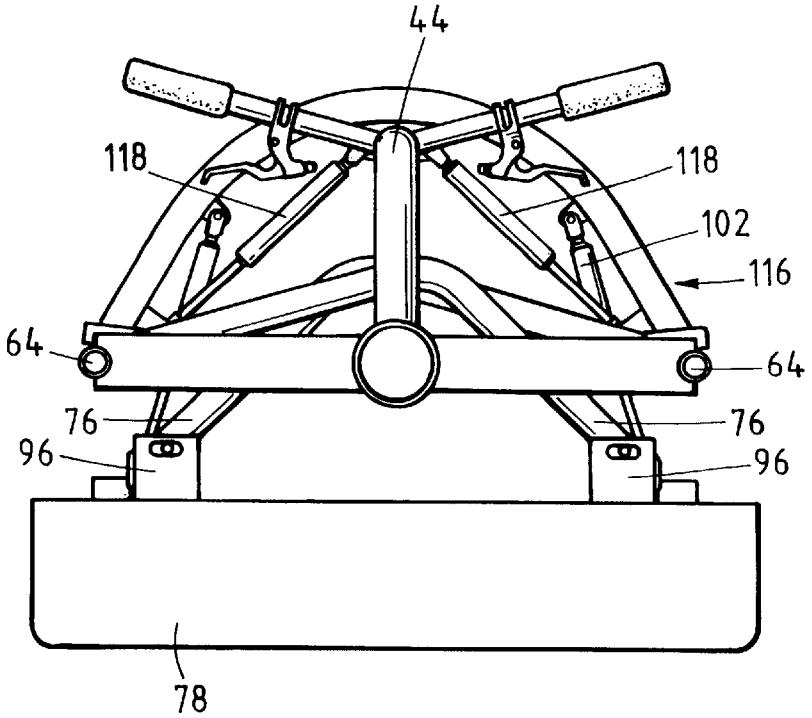
FIG. 9 is a top view of the embodiment in FIG. 8, with the pad in the full advanced position.
Figure 10:
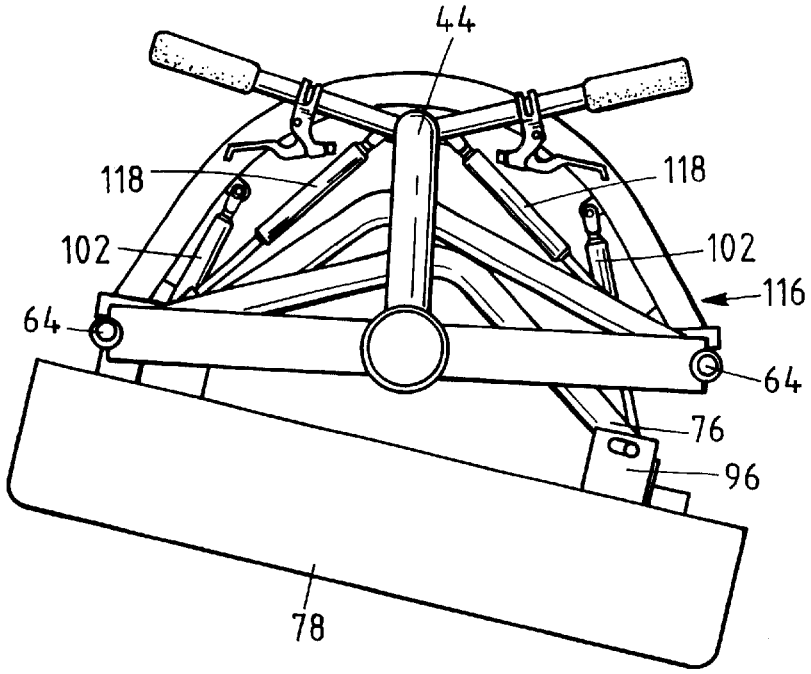
FIG. 10 is a top view of the embodiment of FIG. 8, with the pad in the left side advanced position.
Figure 11:
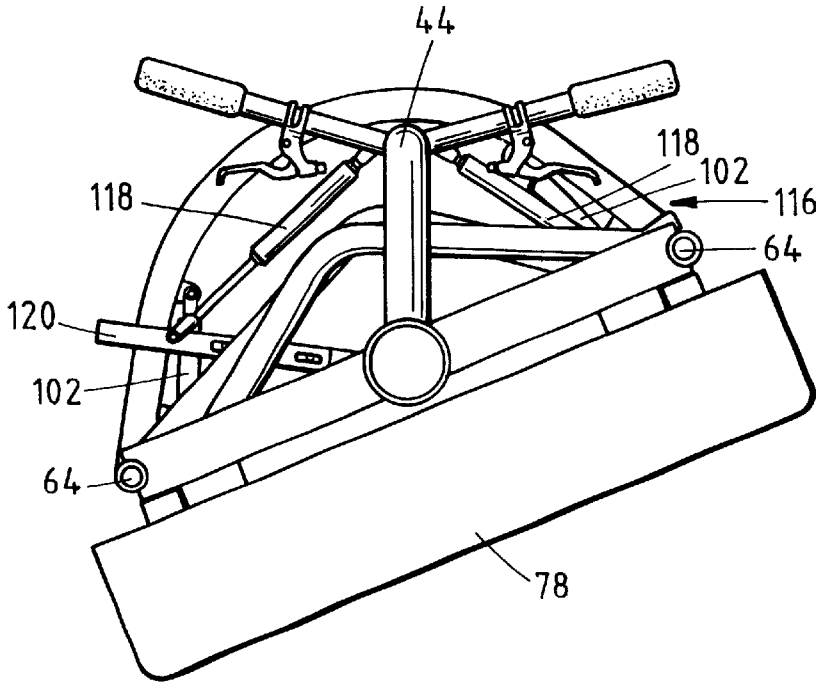
FIG. 11 is atop view of the embodiment of FIG. 10, after a player has struck and rotated the pad against the resistance provided, resetting the primary biasing assembly for the next player and fully compressing the secondary biasing assembly to reach the escape position.

When in operation, the instructor may use one or both of the control levers 112 to advance the pad 78 toward the player and elicit a reaction to such movement. If the pad is in the ready position, as seen in FIGS. 4 and 8, then the instructor may use the right hand control lever to trigger or open the right-hand latch 104, releasing the U-shaped lock bar 98. Once the right latch 104 is triggered, the right side of the pad 78 advances forward (shown in FIG. 3) due to the permitted extension of compressed primary biasing member 102 on the right side, the rotation of collars 66 and corresponding minor axle 64 on the left side, and the pivotal movement at the right hand end of links 76 with respect to associated brackets 96. If the left control level is triggered the pad 78 advances forward on the left side (shown in FIG. 10), due to actuation of a similar set of components for the left side. If both levers 112 are triggered, then both the right and left sides of the pad move forward (shown in FIG. 9) accordingly. This forward translation of the entire pad 78 when both control levers 112 are triggered gives rise to the need for the slots in brackets 96. The slots in brackets 96 allow the ends of links 76 connected to the brackets 96 on the right and left sides, to not only pivot but also to move closer to each other in a scissor-type movement.

When a player strikes pad 78 that was triggered to advance toward him, the player's contact with the pad will normally force the advanced pad portion(s) rearward, resetting any latch 104 that had been triggered, and leaving the pad 78 in the ready position (as shown in FIGS. 4 and 8).

The sled 10 further may be used to train players to fight through an opponent and finish a play. For instance, rather than have the player stop applying force to the pad 78 once the pad has been reset, the player may be instructed to fight through and release from the pad 78 as one would when engaging an opponent. This is permitted with sled 10 of the present invention because once the pad 78 has been rotated sufficiently to reset the primary biasing member(s) 102, the pad 78 may undergo secondary rotation via rotation of sleeve 50 and horizontal members 54 and 56 about major axle 26. Under secondary rotation, the secondary biasing member 118 on the side of the sled 10 receiving the driving force from the player will be compressed until the associated stop 122 (best seen in the embodiment of FIGS. 3 and 4) contacts the collar 124 on rear member 44. Rotation of the pad assembly suspension system 16 compresses one of the secondary biasing members 118, while leaving the other secondary biasing member 118 in its static position. If the pad 78 has undergone secondary rotation, after it is released by the player, the secondary biasing member 118 that was compressed during the rotation will be free to seek its fully extended position and will automatically return the pad 78 to the ready position shown in FIGS. 4 and 8.

It should be understood that any of a variety of fastening means and suitable materials of construction and dimensions may be used to satisfy the particular needs and requirements of the end user. It also will be apparent to those skilled in the art that various modifications and variations can be made in the design and construction of a reaction and technique development sled without departing from the scope or spirit of the invention. Other embodiments of the invention will be apparent to those skilled in the art from consideration of the specification and practice of the invention disclosed herein.

What is claimed is:

1. An athletic training device comprising:

a base;

a pad assembly suspension system connected to the base, said system having at least first and second primary biasing members;

a pad assembly connected to the pad assembly suspension system, said first primary biasing member adapted to impart rotation of the pad assembly about a first axis of rotation and said second primary biasing member adapted to impart rotation of the pad assembly about a second axis of rotation which is spaced apart from said first axis of rotation;

a control system connected to the pad assembly suspension system; and at least one secondary biasing member connected to the pad assembly suspension system;

wherein the control system and pad assembly suspension system are adapted to selectively advance at least a portion of the pad assembly when the control system is triggered.

2. An athletic training device in accordance with claim 1, wherein said pad assembly suspension system and said secondary biasing member are adapted to permit rotation of said pad assembly.

3. An athletic training device in accordance with claim 1, wherein said pad assembly is suspended forward of said pad assembly suspension system.

4. An athletic training device in accordance with claim 1, wherein said control system, said pad assembly and said pad assembly suspension system are adapted to selectively advance the entire pad assembly.

5. An athletic training device in accordance with claim 1, wherein said at least one secondary biasing member is adapted to reset the position of the pad assembly suspension system after the pad assembly has been contacted by a player.

6. A football practice sled comprising a base, a pad assembly suspension system connected to said base, a pad assembly connected to said pad assembly suspension system, and a control system connected to said pad assembly suspension system, wherein said pad assembly suspension system is adapted to permit primary and secondary rotation of said pad assembly and said control system may be activated to select at least an initial primary rotation of said pad assembly.

7. A football practice sled in accordance with claim 6, wherein said pad assembly suspension system has a reset position adapted to be engaged after said initial primary rotation of said pad assembly.

8. A football practice sled in accordance with claim 7, wherein said pad assembly suspension system is adapted to permit secondary rotation of said pad assembly after said pad assembly has been returned to said reset position.

9. A football practice sled in accordance with claim 6, wherein said pad assembly suspension system is further adapted to permit fore and aft translation of said pad assembly.

10. A football practice sled in accordance with claim 6, further comprising at least one biasing member adapted to resist said secondary rotation of said pad assembly.

11. A football practice sled in accordance with claim 6, further comprising at least one biasing member adapted to impart said initial primary rotation of said pad assembly when said control system is activated.

12. A football practice sled comprising:

a base further comprising ground engaging runners and an upwardly extending collar;

an axle having a substantially vertical axis of rotation, said axle connected to said collar;

a pad assembly suspension system connected to said axle;

a pad assembly connected to said pad assembly suspension system; and said pad assembly suspension system further comprising at least one primary biasing member adapted to impart movement of said pad assembly relative to said base.

13. A football practice sled in accordance with claim 12, wherein said primary biasing member also is adapted to resist a force applied to said pad assembly.

14. A football practice sled in accordance with claim 13, wherein said sled has a reset position and said primary biasing member is compressed when said sled is in said reset position.

15. A football practice sled in accordance with claim 14, wherein said sled further comprises at least one latch connected to said pad assembly to restrain movement of said pad assembly by said compressed primary biasing member when said sled is in said reset position.

16. A football practice sled in accordance with claim 12, further comprising at least one secondary biasing member adapted to resist a force applied to said pad assembly.

17. A football practice sled in accordance with claim 16, wherein said sled has a reset position and said at least one secondary biasing member is substantially not compressed when said sled is in said reset position.

18. A football practice sled in accordance with claim 17, wherein said at least one secondary biasing member is adapted to force said sled to return to said reset position.

* * * * *